US005833001A

United States Patent [19]

Song et al.

[11] Patent Number: 5,833,001

[45] Date of Patent: Nov. 10, 1998

[54] SEALING WELL CASINGS

[75] Inventors: Haoshi Song, Sugar Land; Jack F. Lands, Jr., West Columbia, both of Tex.; Wallace E. Voreck, Sparta, N.J.

[73] Assignee: Schlumberger Technology Corporation, Sugar Land, Tex.

[21] Appl. No.: 768,027

[22] Filed: Dec. 13, 1996

[51] Int. Cl.[6] ..... E21B 33/13; E21B 36/00

[52] U.S. Cl. ..... 166/287; 166/57; 166/187; 166/207; 166/277; 166/288; 166/295; 166/300

[58] Field of Search ..... 166/57, 187, 206, 166/207, 277, 287, 288, 295, 300, 302

[56] References Cited

U.S. PATENT DOCUMENTS

| | | | |
|---|---|---|---|
| 2,286,075 | 6/1942 | Evans | 166/277 X |
| 3,067,819 | 12/1962 | Gore | 166/277 X |
| 3,134,442 | 5/1964 | Jennings | 166/207 |
| 3,175,618 | 3/1965 | Lang et al. | 166/207 X |
| 3,354,955 | 11/1967 | Berry | 166/207 X |
| 3,364,993 | 1/1968 | Skipper | 166/207 X |
| 3,477,506 | 11/1969 | Malone | 166/207 |
| 3,482,629 | 12/1969 | Suman, Jr. | 166/277 X |
| 3,935,910 | 2/1976 | Gaudy et al. | 166/288 X |
| 4,971,152 | 11/1990 | Koster et al. | 166/277 |
| 5,337,823 | 8/1994 | Nobileau | 166/277 |
| 5,456,319 | 10/1995 | Schmidt et al. | 166/373 |
| 5,494,106 | 2/1996 | Geuguen et al. | 166/277 |
| 5,613,557 | 3/1997 | Blount et al. | 166/277 |

OTHER PUBLICATIONS

AMCP 706–185 "Engineering Design Handbook, Military Pyrotechnics Series Part One, Theory and Application" Headquarters, U.S. Army Materiel Command, Apr. 1967, 7 total pages (excerpts), including title page, pp. 5–6, 5–25, 5–40, 5–48, 5–49 and one unnumbered page entitled: Engineering Design Handbooks.

Linerflex In Situ Polymerisation Technology "Patch–Flex," pp. 1–4 (Sep. 1995).

Drillflex Casing System, "Patch–Flex Characteristics and Availability" pp.1–2 (Feb. 1996).

J.L. Saltel et al., "In–situ Polymerisation of an Inflatable Sleeve to Reline Damaged Tubing and Shut–off Perforations," Offshore Technology Conference, pp. 1–9 (1996).

*Primary Examiner*—George A. Suchfield

*Attorney, Agent, or Firm*—Gordon G. Waggett; John J. Ryberg; John Bouchard

[57] ABSTRACT

An apparatus and method for sealing an inner wall of a portion of a casing positioned in a well employs an inflatable sleeve having an outer surface and a conformable composite sleeve of curable composition extending around the outer surface of the inflatable sleeve. The inflatable sleeve is inflated to compress the composite sleeve against the surface of the inner casing wall. A local, activatable energy source, positioned downhole to deliver heat to the composite sleeve, is activated to cure the composite sleeve to form a hardened sleeve. The hardened sleeve presses against the inner wall of the casing portion to create a fluid seal. The embodiments shown have a number of preferred features. The local energy source includes an exothermic heat energy source for generating heat energy to cure the composite sleeve. The composite sleeve includes a mixture of resin and a curing agent, and the exothermic heat source includes thermite. The thermite includes a composition having a metal oxide and a reductant. A starter mix is positioned adjacent the exothermic heat energy source, and the starter mix is ignited to start an exothermic reaction in the heat energy source. A conformable layer extends around the composite sleeve, with the layer serving to form a seal between the composite sleeve and the inner wall of the casing portion.

26 Claims, 7 Drawing Sheets

SEALING WELL CASINGS

BACKGROUND

The invention relates to sealing well casings.

After a well has been drilled and the casing has been cemented in the well, one or more sections of the casing adjacent pay zones are perforated to allow fluid from the surrounding formation to flow into the well for production to the surface. Perforating guns are lowered into the well and the guns are fired to create openings in the casing and to extend perforations into the surrounding formation. In the well shown in FIG. 1, two perforated regions 14 and 16 in the formation are shown next to two different sections of the casing 12 in a well 10.

Contaminants (such as water or sand) are sometimes produced along with the oil and gas from the surrounding formation. In the system shown in FIG. 1, during production, fluid flows from the perforated regions 14 and 16 through perforated openings in the casing 12 into the bore 20 of the well 10. The fluid then rises up through a production tubing 18 to the surface. A packer 22 positioned near the bottom of the production tubing 18 is used to seal off well fluids from the annulus 24 between the production tubing 18 and the casing 12.

If contaminants are detected in the fluid from the production tubing 18, then a logging tool is lowered into the well 10 to determine the source of the contaminants. If, for example, the source of contaminants is the perforated region 14, then the perforated openings in the casing 12 are sealed to prevent fluid flow from the perforated region.

To seal the desired section of the casing 12, one technique typically used is referred to in the industry as a "squeeze job." First, the production tubing 18 is removed from the well. Then, the zone in the casing 12 adjacent the general area of the perforated region 14 is isolated using temporary packers. Cement is pumped down the bore 20 through a tube to the isolated zone to seal the perforated openings in the desired section of the casing 12. Drilling out of the cement is then required if production is desired from a lower payzone.

Another technique has been proposed for sealing casing sections downhole, which is described in J. L. Saltel et al., "In-Situ Polymerization of an Inflatable Sleeve to Reline Damaged Tubing and Shut-Off Perforations," Offshore Technology Conference, pp. 1–11 (May 1996). A cable carrying seven electrical conductors is used to lower an inflatable sleeve which carries a permanent sleeve (comprised of resins, fibers, and elastomers) downhole. The inflatable sleeve is pressurized to push the permanent seal against the inside surface of the casing. Electric power provided down the wireline from the surface is used to generate heat to increase the temperature of the resin for a sufficient period of time to cross link (or "cure") the resin in the permanent sleeve. The permanent sleeve is left downhole to maintain a seal over perforated sections of the casing.

The electrical energy required to cross link the resin in the system of Saltel et al. varies between 400 W/m and 1,900 W/m, depending upon the diameters of the casing. To provide the necessary electrical energy, a 1,250-volt DC supply is used at the surface to generate about 2.5 amps of current through each of the seven conductors and the associated resistive elements.

SUMMARY

In general, in one aspect, the invention features an apparatus for sealing an inner wall of a portion of a casing positioned in a well. The apparatus includes an inflatable sleeve having an outer surface and a deformable composite sleeve of curable composition extending around the outer surface of the inflatable sleeve, in which the inflatable sleeve is inflated to compress the composite sleeve against the surface of the inner casing wall. A local energy source is positionable downhole near the composite sleeve, and the energy source is activated to cure the composite sleeve to form a hardened sleeve. (The term "local" is used here to exclude energy sources that require substantial remote power generation and conductors for that power.) The hardened sleeve presses against the inner wall of the casing portion to create a fluid seal.

In general, in another aspect, the invention features a method of sealing an inner wall of a portion of a casing positioned in a well. An inflatable sleeve having an outer surface is lowered down the well to the portion of the casing. A composite sleeve extends around the outside of the inflatable sleeve. The inflatable sleeve is inflated to compress the composite sleeve against the surface of the inner casing wall. A local energy source is activated to cure the composite sleeve to form a hardened sleeve. The hardened sleeve presses against the inner wall of the casing portion to create a fluid seal.

Implementations of the invention may include one or more of the following features. The local energy source has an exothermic heat energy source for generating heat energy to cure the composite sleeve. The composite sleeve includes a mixture of resin and a curing agent. The mixture is cured to a hardened epoxy layer after exposure to the heat energy. The exothermic heat source includes thermite. The thermite includes a composition having a metal oxide and a reductant. The metal oxide is selected from a group consisting of iron oxide and copper oxide. The reductant is selected from a group consisting of aluminum and silicon. A starter mix is positioned adjacent the exothermic heat source, and the starter mix is ignited to start an exothermic reaction in a heat energy source. The exothermic heat energy source heats the temperature to greater than about 50° C. above the ambient temperature of the well. A carrying tool carries the inflatable sleeve, the composite sleeve, and the energy source down the well to the casing portion. The well includes a production tubing having a first diameter, and the carrying tool has a second diameter less than the first diameter to allow the carrying tool to be lowered down the production tubing. A conformable layer of sheet or film extends around the composite sleeve, and the layer acts to form a seal between the composite sleeve and the inner wall of the casing portion.

Advantages of the invention may include one or more of the following. Production tubing can be left in place in the well while a section of the casing is being sealed, which reduces significantly production down time and the cost associated with the casing perforation seal job. The energy source needed for the seal job is local, downhole, which avoids the issues associated with providing high energy from a surface source. As the energy source is carried downhole with the sealing apparatus, and can be sized to the length to be sealed, the effectiveness of the energy source is not affected by the length of the seal or the depth of the well. The inner diameter of the composite sleeve is large enough to allow passage of tools for further operations below it in the well.

Other advantages and features will become apparent from the following description and from the claims.

DESCRIPTION

To seal portions of the casing, a tool carrying a sealing sleeve that includes an inner inflatable sleeve and an outer permanent sleeve (containing an epoxy layer having a mixture of resin and a curing agent, and a sealing film around the epoxy layer) is lowered downhole to a desired section of the casing. Once properly positioned downhole, the inflatable sleeve is inflated to compress the permanent sleeve against the inner surface of the casing. The permanent sleeve is then cured under compression to form a hardened epoxy sleeve using a local source of heat energy lowered downhole with the sealing sleeve by the carrying tool. The local source of heat energy may be, by example, a thermite bar in which an exothermic reaction is started to create a sufficient amount of heat energy to cure the epoxy in the permanent sleeve. The permanent sleeve, after the epoxy material has cured, stays fixed to the inner surface of the casing section, and the inflatable sleeve is deflated and detached from the permanent sleeve to allow the tool to be pulled out. In this manner, a casing seal can be created without the need for a high power electrical energy source located at the surface and means to conduct that energy downhole.

Figure 1:
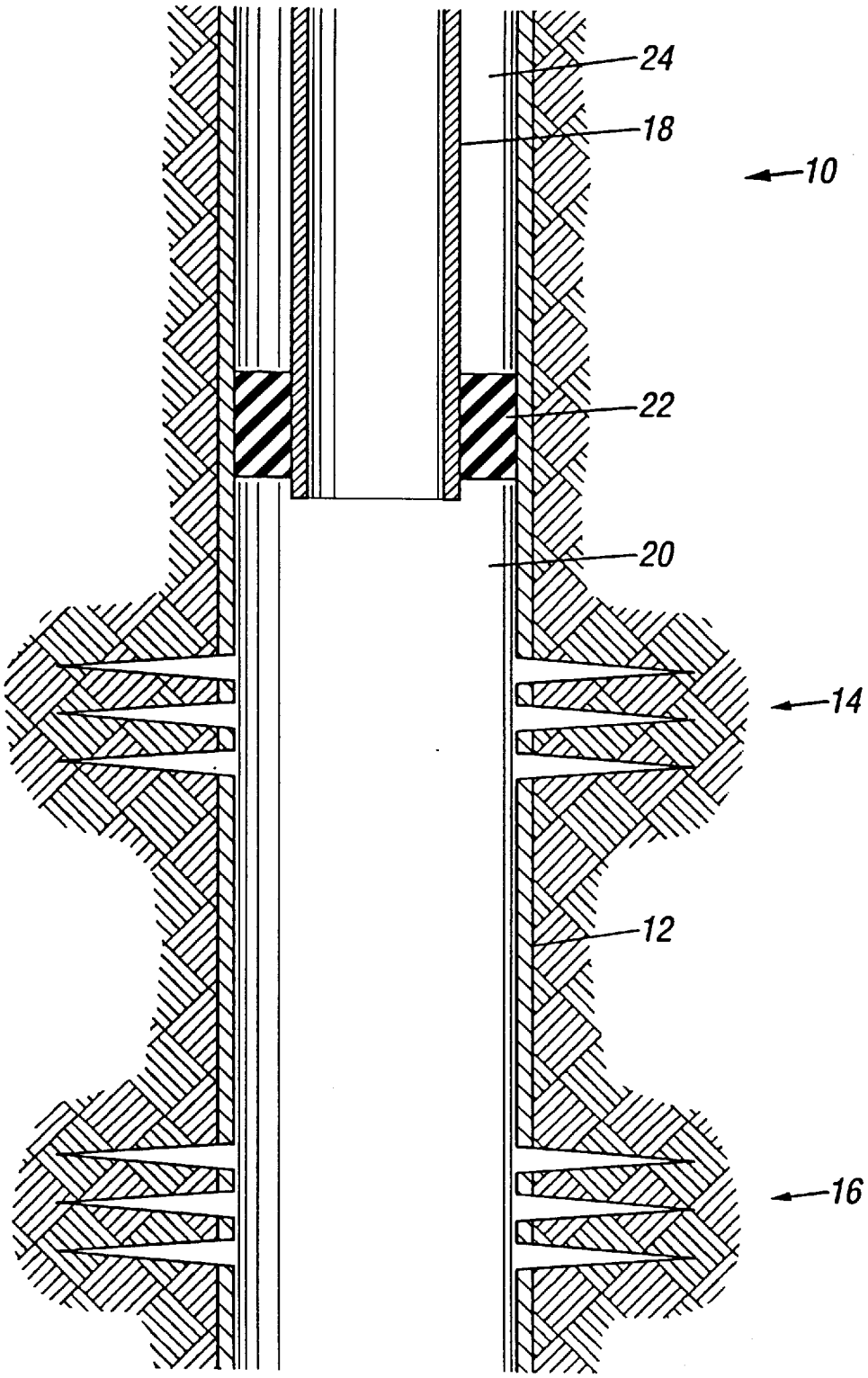
FIG. 1 (Prior Art)
FIG. 1 is a diagram of a casing having perforated portions.
Figure 2:
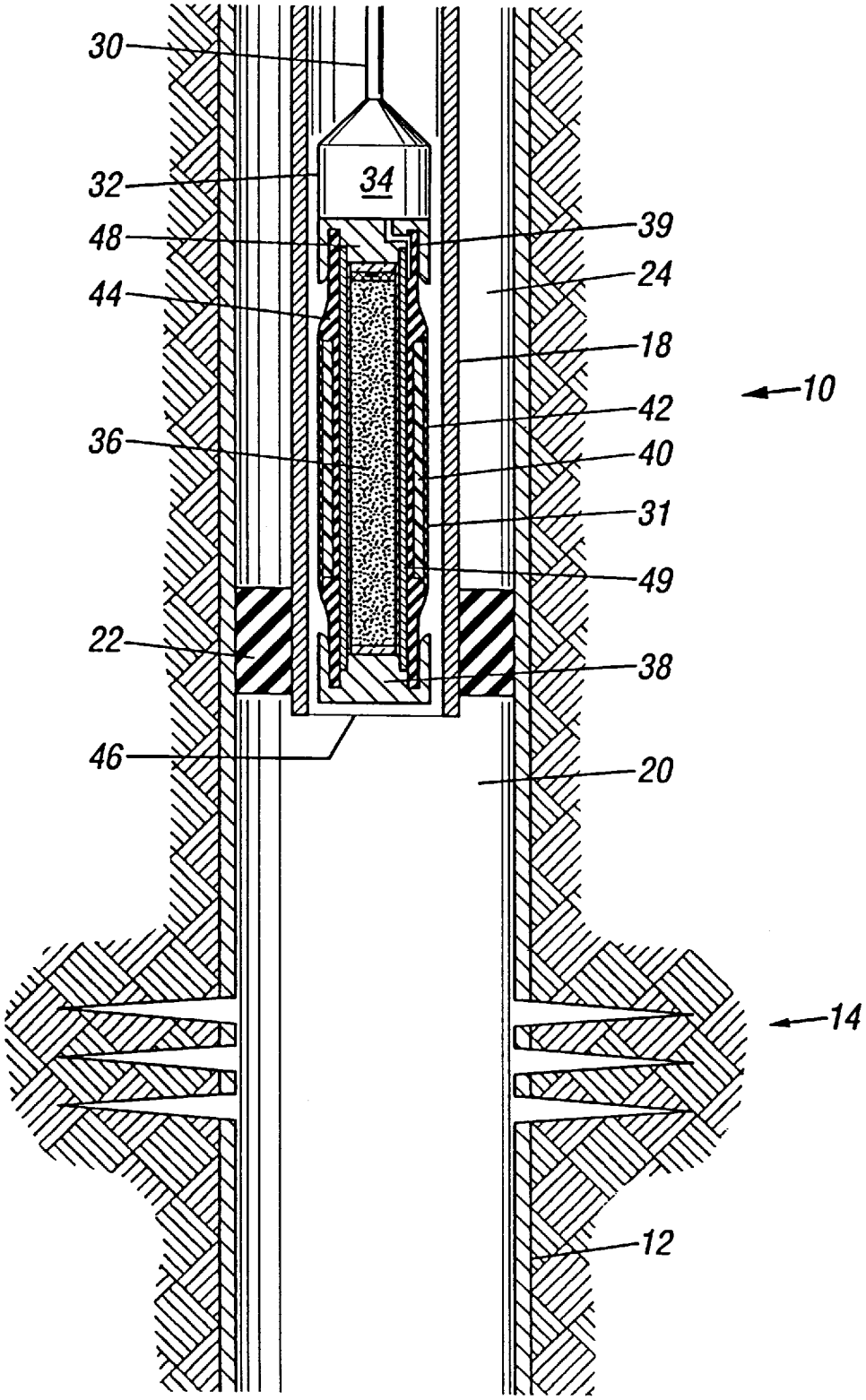
FIG. 2 is a diagram of a tool carrying a sealing sleeve down a production tubing located in a casing.

Referring to FIG. 2, a tool 32 carrying a sealing sleeve 31 is lowered down a production tubing 18 into the bore 20 of the well 10. As shown in FIG. 2, and in greater detail in FIGS. 3 and 4, the carrying tool 32 includes a tool head 34 attached to a wire line or coiled tubing 30, which extends up to the surface. The tool head 34 is attached to the tool housing 48, which holds the sealing sleeve 31. The tool housing 48 includes an upper metal cap 39, a lower metal cap 38, and a metal tube 49. The metal tube 49 is attached to the upper and lower caps 39 and 38 with threads (not shown).

The sealing sleeve 31 is supported at the lower end of the tool 32 by the lower support metal cap 38 and at the upper end by the upper support metal cap 39. A cylindrical thermite bar 36 is positioned approximately along the center of the tool housing 48 inside the metal tube 49, and enclosed on the top and bottom by the upper and lower caps 39 and 38, respectively.

The sealing sleeve 31 includes a generally tubular, inflatable bladder 44 (such as an elastic bladder formed e.g., of heat resistant elastomer such as silicone rubber), which is shown in its initial, deflated state in FIG. 2. A thin elastomer film or sheet 42 is stretched around the middle section of the bladder 44. An epoxy layer 40 (which is a mixture initially in paste form of resin and a curing agent) is inserted in the region between the bladder 44 and the film 42. The combination of the epoxy sleeve 40 and the film 42 forms the permanent sleeve. Alternatively, a cyclindrical layer of reinforcing materials, such as fibers or fabrics, could be used with the epoxy layer 40 to increase the strength of the permanent sleeve.

In one composition, the epoxy layer 40 is 100 parts resin and 28 parts curing agent (by weight). The resin is initially in liquid form. The curing agent can be the Ancamine™ agent (which is modified polyamine in powder form) from Air Products & Chemicals, Inc. Once mixed, the resin and curing agent form a paste material that can be pumped into the region between the bladder 44 and the film 42. The bladder 44 includes an epoxy fill port (not shown) and a vacuum port (not shown). The region is first evacuated through the vacuum port and then the epoxy layer is pumped into the region between the bladder 44 and film 42 through the epoxy fill port.

Different curing agents are available which cause the epoxy layer to cure at different temperatures. Because of varying downhole temperatures (which depend on such factors as the depth and pressure of the well), the flexibility to choose different curing temperatures is important. The range of minimum curing temperature can be between 100° C. and 130° C.

Figure 3:
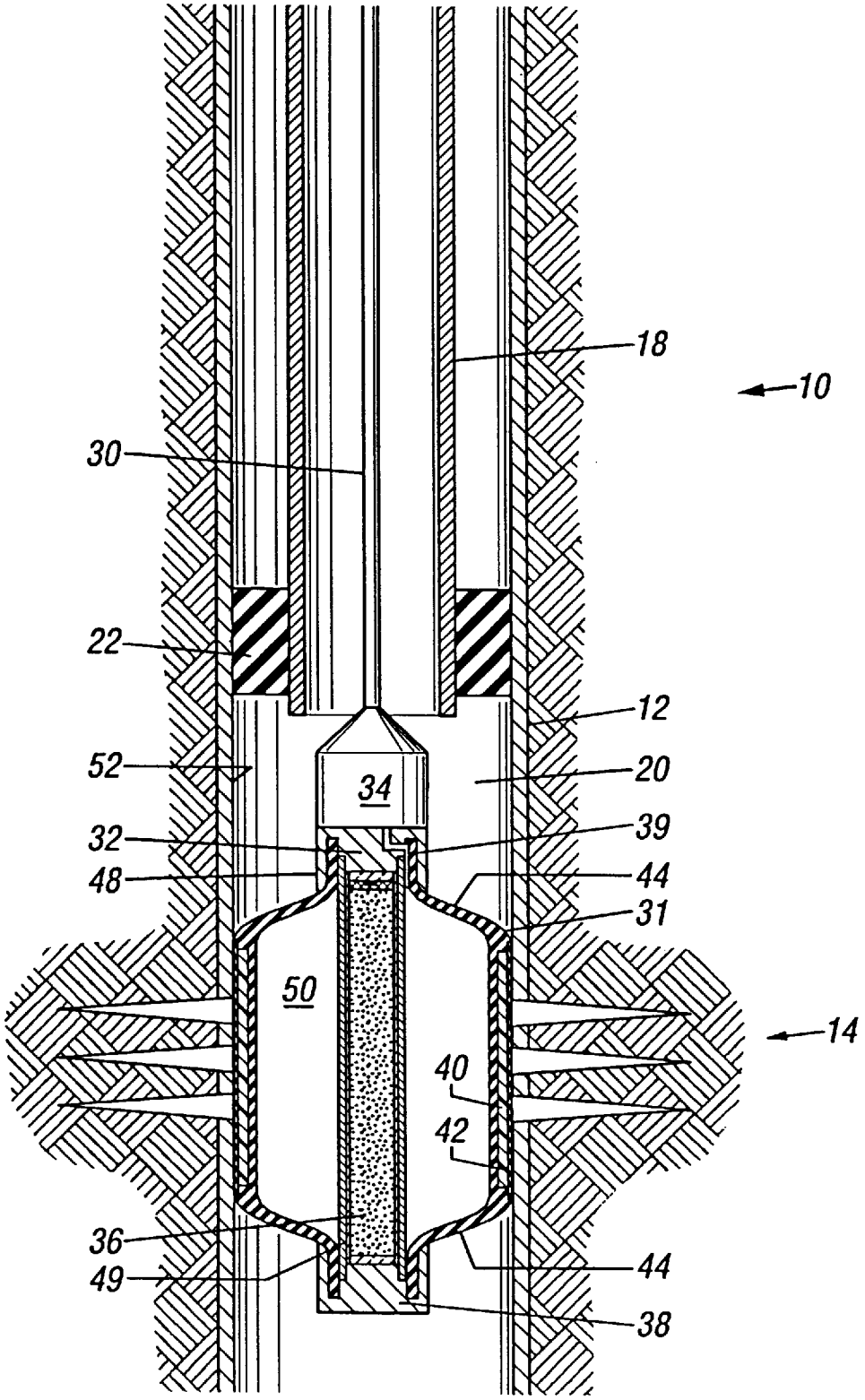
FIGS. 3 and 4 are diagrams of the sealing sleeve being positioned next to perforated openings in the casing and being inflated to press the sealing sleeve against the inner wall of the casing.

Referring to FIG. 3, the carrying tool 32 is shown positioned next to the portion of the casing 12 which is to be sealed using the sealing sleeve 31. Once the sealing sleeve 31 is properly positioned, a pump located in the tool head 34 is activated (from the surface) to inflate the elastomer bladder 44 by pumping fluid (e.g., water or surrounding well fluid) through line 60 (FIG. 4) into the space 50 in the bladder 44. The inflation of the bladder 44 pushes the permanent sleeve (made up of the epoxy sleeve 40 and the elastomer film 42) against the inner wall 52 of the casing 12. The thermite bar 36 remains fixed in position by the metal tube 49, the lower cap 38, and the upper cap 39.

Figure 4:
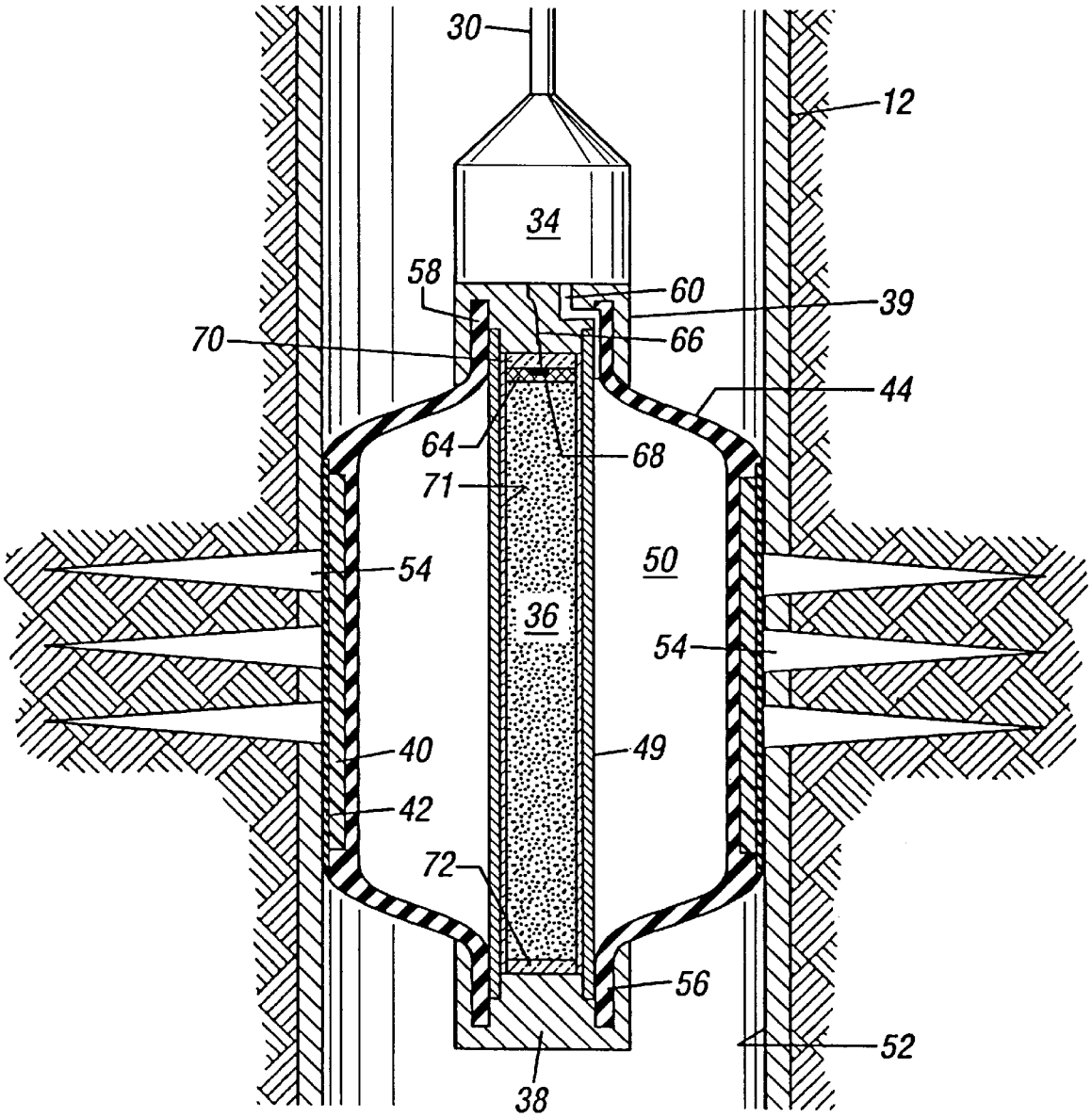

Referring to FIG. 4, the section of the tool 32 carrying the sealing sleeve 31 is shown in greater detail. The elastomer bladder 44 is shown in its inflated state pushing the permanent sleeve against the inner wall 52 of the casing section containing perforated openings 54. The elastomer bladder 44 is fitted between an upper slot 58 in the upper support cap 39 and a lower slot 56 in the lower support cap 38. The pump in the tool head 34 pumps fluid into the space 50 in the bladder 44 through a fluid charge and discharge line 60 to inflate the bladder.

If the system is used with a wireline, then commands to activate the pump can be electrical signals. If, on the other hand, the system is used with coiled tubing, pressure pulse signals can be used, with a pressure pulse decoder located in the tool head to sense the pressure pulse signals and to activate the pump if appropriate signals are received.

A starter mix layer 64 overlays and is adjacent the top surface of the thermite bar 36. A firing resistor 68 is positioned inside the starter mix layer 64, and is connected by a wire 66 to an electrical source (not shown) in the tool head 34. The electrical source is switched on by an operator on the surface to fire the firing resistor 68, which in turn fires the starter mix 68. The electrical source can be activated by an electrical signal through a wireline or pressure pulse signals if coiled tubing is used.

The starter mix 64 can be any composition which can be ignited with the firing resistor 68, such as a composition having a mixture of barium oxide ($BaO_2$) and magnesium (Mg). After the starter mix 64 is ignited, a self-sustainable exothermic reaction is initiated in the thermite 36, which releases a sufficient amount of heat energy to cause the thermite mixture to react, melt, and become a mixture of molten metal and reductant oxide. The exothermic reaction is expressed by Eq. 1:

$$MeO+R=>Me+RO+heat, \quad (Eq.1)$$

in which Me stands for a metal, R stands for a reductant, and O stands for oxygen. This kind of thermite is a gasless mixture, i.e., it does not generate gases during the exothermic reaction. This avoids problems associated with pressure build up downhole if gases are produced.

If the thermite mixture includes iron oxide and aluminum, the exothermic reaction is expressed by Eq. 2.

$$Fe_2O_3+2Al=>2Fe+Al_2O_3+heat \quad (Eq.2)$$

The thermite 36 also can include other mixtures, including a mixture of copper oxide (CuO or $Cu_2O$) and silicon (Si), or a mixture of iron oxide (FeO, $Fe_2O_3$, or $Fe_3O_4$) and silicon (Si). If the mixture contains copper oxide and silicon, the exothermic reaction is expressed as Eq. 3.

$$2CuO+Si=>2Cu+SiO_2+heat \quad (Eq. 3)$$

If the mixture contains iron oxide and silicon, the exothermic reaction is expressed as Eq. 4.

$$2Fe_2O_3+Si=>4Fe+3SiO_2+heat \quad (Eq. 4)$$

An upper insulation layer 70 is positioned between the starter mix 64 and the upper support cap 39, and a lower insulation layer 72 is positioned between the thermite bar 36 and the lower support cap 38. In addition, an insulation layer 71 lies between the thermite bar 36 and the metal tube 49. The insulation layers 70, 71, and 72 prevent the heat generated by the reacting thermite 36 from melting the metal parts 39, 49, and 38, respectively. The insulation layers can be made of a carbon/resin composite material.

The amount of heat generated by the exothermic reaction transfers by radiation and convection to the outer layers and typically elevates the temperature of the epoxy layer 40 to about 50° C. to 150° C. above the ambient temperature of the well 10 for a few hours. Such elevated temperatures for this length of time are sufficient to cure the resin and curing agent mixture in the epoxy sleeve 40 to transform the paste mixture into a hardened epoxy sleeve. Once the epoxy sleeve 40 is hardened, it remains fixed against the inside surface 52 of the casing section, and the elastomer film 42 acts as a seal to prevent fluid flow from the formation through the perforated openings 54 of the casing.

Figure 5:
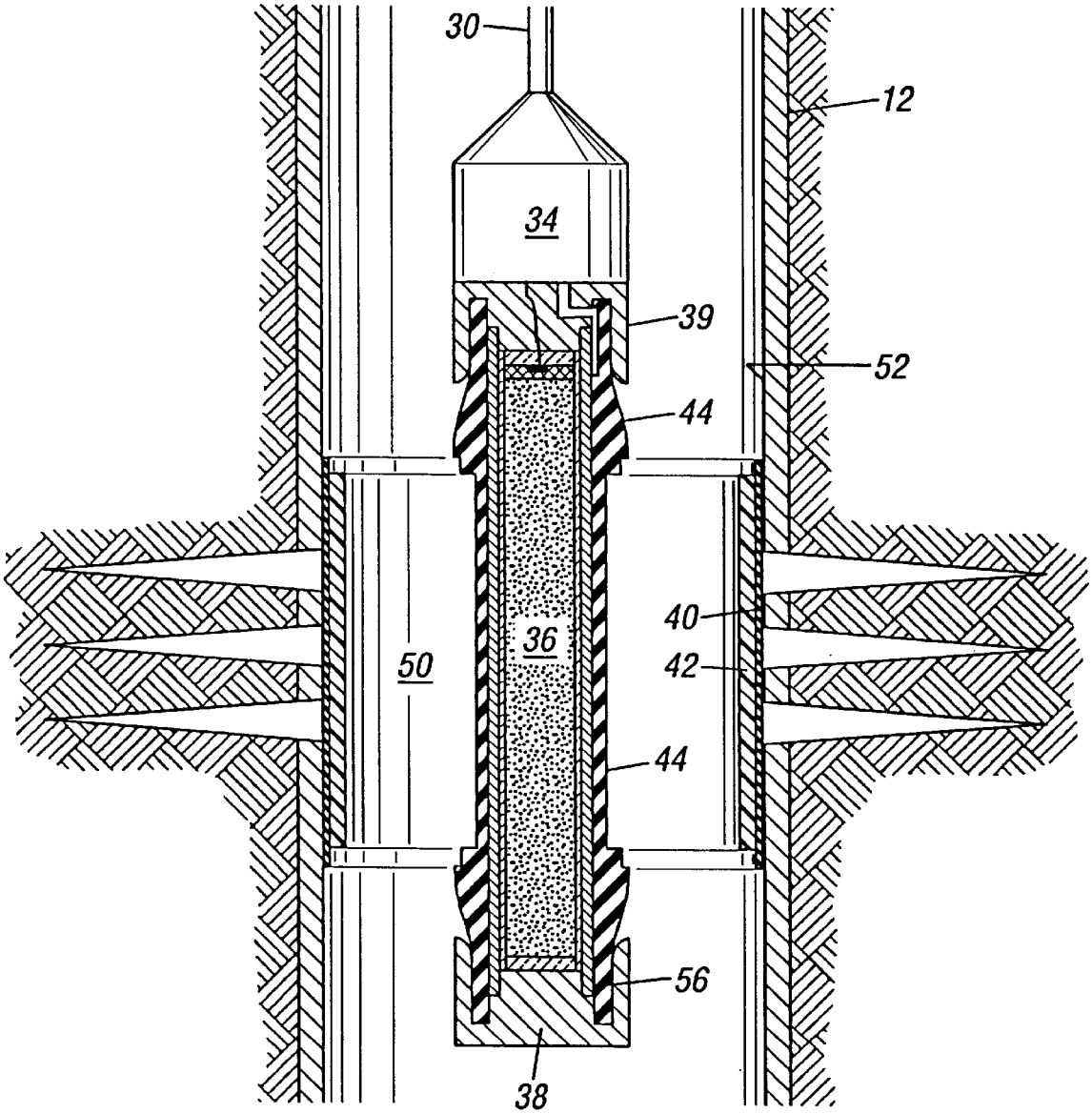
FIG. 5 is a diagram of a permanent sleeve layer after it has been cured and an inflatable sleeve layer which has been deflated after the curing process.

Referring to FIG. 5, once the epoxy layer 40 in the permanent sleeve has been cured, the pump in the tool head 34 discharges fluid from the bladder 44 to deflate the bladder. The deflated bladder 44 radially contracts and peels away from the epoxy sleeve 40. The carrying tool 32 can then be raised back through the production tubing 18 by the wireline or coiled tubing 30.

Figure 6A:
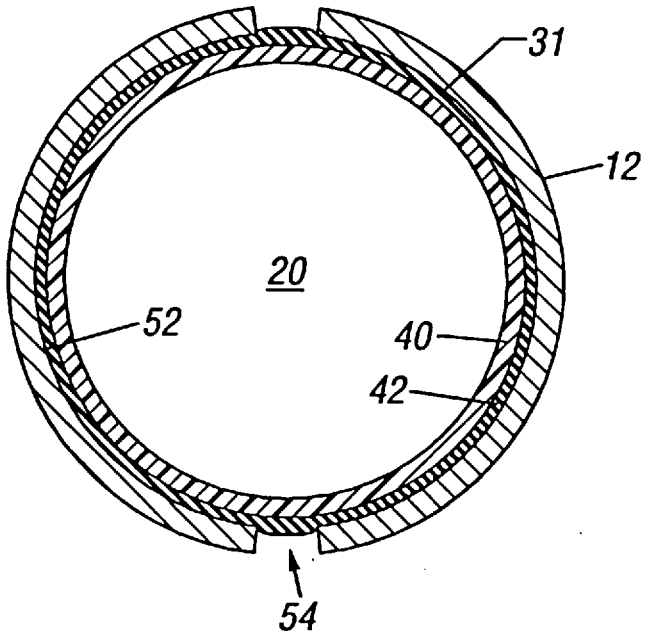
FIGS. 6A and 6B are cross-sectional diagrams of the permanent sleeve placed in the casing.
Figure 6B:
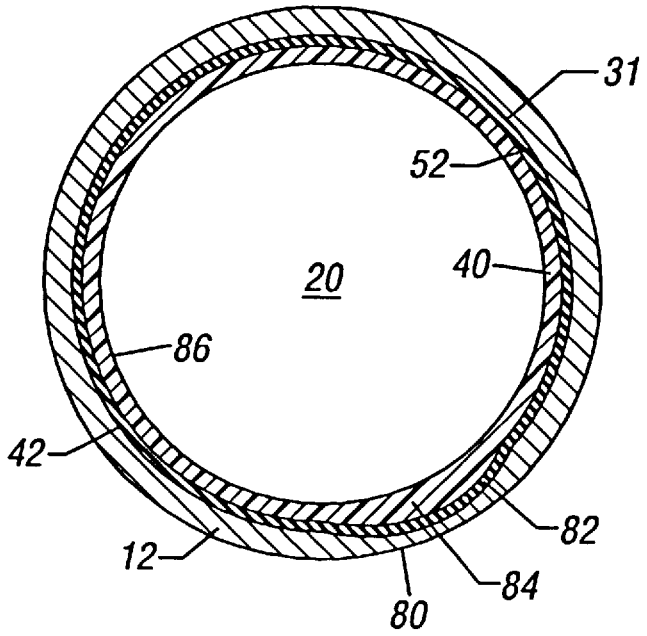

Referring to FIGS. 6A–6B, cross-sectional views of the permanent sleeve in place in the casing 12 show the epoxy sleeve 40, the elastomer film 42, and the casing 12. FIG. 6A shows the cross-sectional view of a casing having perforated holes 54. Because it has been cured under compression, the hardened epoxy sleeve 40 continues to press the elastomer film 42 against the inner wall 52 of the casing 12 and seals the perforated openings 54, preventing fluid flow from the surrounding formation through the perforated openings 54 to the casing bore 20. At the perforated holes 54, as a result of the compressive forces during curing, the elastomer film or sheet 42 partially extends into the holes 54, conforming to the hole edges, thereby improving the seal characteristics of the permanent sleeve at the edges of the holes.

In FIG. 6B, the casing 12 is shown with a defective portion 80, in which the casing wall is thinner than the rest of the casing. Such a defect can cause cracks or other openings to form in the casing wall such that fluid from the formation may leak into the well bore 20. The permanent sleeve also can be used to seal such a defective section in the casing 12. As shown in FIG. 6B, during the curing process, the section 84 of the epoxy sleeve 40 extends to conform to the shape of the casing wall. Although the outer surface of the epoxy sleeve 40 deforms to conform to the casing wall, the inner surface 86 of the epoxy sleeve 40 remains substantially cylindrical. The section 84 of the epoxy sleeve 40 presses the corresponding section of the elastomer film 82 against the defective portion 80 of the casing wall to prevent fluid from the surrounding formation leaking through cracks or other openings in the casing wall section 80.

The sealing sleeve described above can be used in many applications. One such application is the isolation of contaminants, such as water and/or sand, by sealing perforated sections of the casing. Another application is to completely or partially seal casing sections through which excessive gas is flowing from the surrounding formation, which can cause the pressure in the surrounding perforations to drop prematurely and adversely affect the producing characteristics of the well.

In another application, the sealing sleeve can be used to isolate zones in a horizontal well. Producing characteristics along the horizontal well can change over time. Thus, if a particular section of the horizontal well is no longer producing, that section can be isolated using the sealing sleeve to seal off the perforated openings of the casing in the horizontal well.

Figure 7:
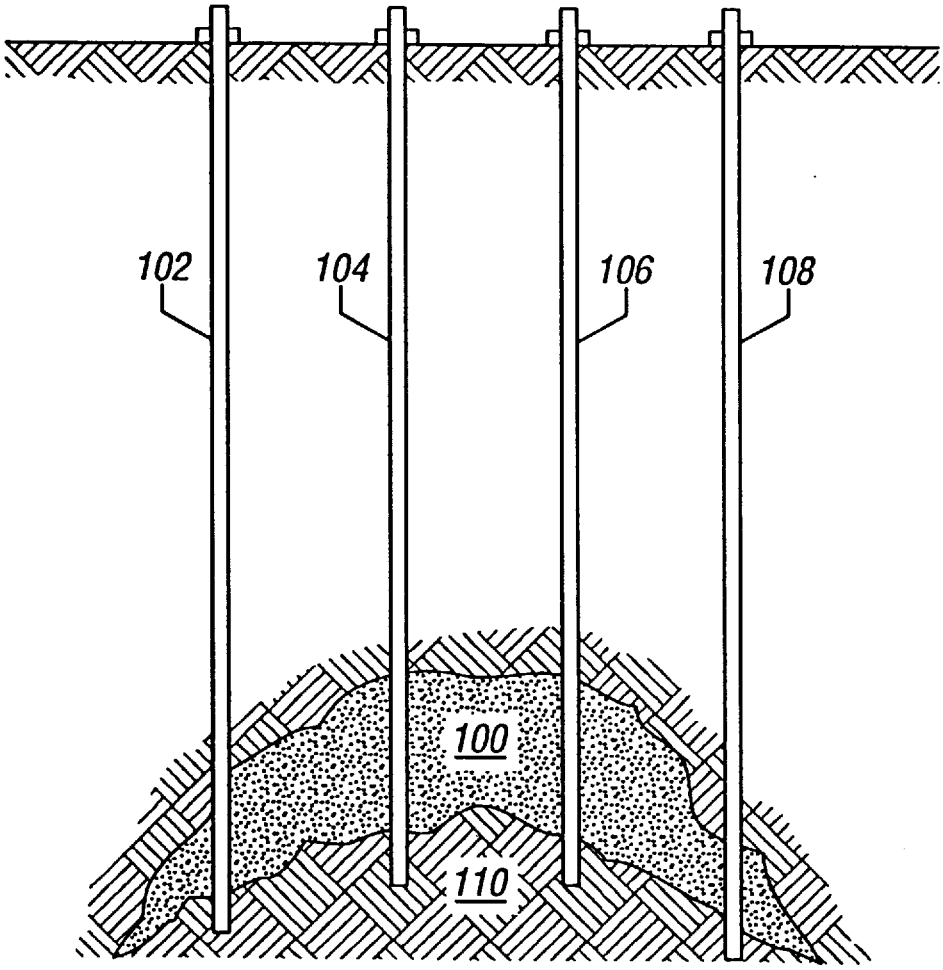
FIG. 7 is a diagram of multiple wells drilled through a formation to illustrate how the sealing sleeve can be used to modify the injection profile of a pay zone.

Another application of the sealing sleeve is to modify the injection profiles of a pay zone. For example, referring to FIG. 7, four wells 102, 104, 106 and 108 are drilled through a pay zone 100 to produce oil. If it is determined that pressure is inadequate for production purposes, the perforations of some of the wells can be sealed so that water or air can be pumped into the formation 110 below the pay zone 100 to increase the pressure at the producing wells. For example, perforations in the wells 102 and 108 adjacent the pay zone 100 can be sealed using sealing sleeves. Once sealed, water or air can be pumped down the wells 102 and 108 for injection at a lower level to increase the formation pressure for wells 104 and 106 and thereby improve production in the wells 104 and 106.

Other embodiments are also within the scope of the following claims. For example, other types of curing agents which when mixed with resin will achieve desirable curing temperatures can be used. A different exothermically reactive source other than thermite can be used to generate the required heat. Depending upon the temperatures achieved, the exothermically reactive source or other energy source may be incorporated as an inner or outer layer of the inflatable sleeve or as a layer within the substance of the internal sleeve. The layer in the permanent sleeve can contain a photosensitive material that is curable with a light source, and the downhole activatable energy source can produce light of appropriate curing wavelength, e.g., ultraviolet, instead of heat. The source of light may be outside of the inflatable sleeve, or the sleeve may be light-transmissive to enable light produced within the inflatable sleeve to reach the composite sleeve. Powered by a battery or a low power connection to the surface, the inflatable sleeve may comprise a bellows-like thermallyresistant metal sleeve. The inflatable sleeve may be inflated and deflated by a pump at the surface. The apparatus and method may be realized using multiple steps for positioning the composite sleeve, inflatable sleeve and local heat source.

What is claimed is:

1. Apparatus for sealing an inner wall of a portion of a casing positioned in a well, comprising:

an inflatable sleeve having an outer surface;

a deformable composite sleeve of a curable composition extending around the outer surface of the inflatable sleeve, wherein the inflatable sleeve is inflatable to compress the composite sleeve against the surface of the inner casing wall; and a local activable heat source positioned downhole near the composite sleeve, the heat source being activatable to generate heat energy to cure the composite sleeve to form a hardened sleeve, wherein the hardened sleeve presses against the inner wall of the casing portion to create a fluid seal.

2. The apparatus of claim 1, wherein the local activable heat source includes an exothermic heat energy source.

3. The apparatus of claim 1, wherein the composite sleeve includes a mixture of resin and a curing agent.

4. The apparatus of claim 3, wherein the mixture is curable to a hardened epoxy layer after exposure to the heat energy.

5. The apparatus of claim 1, wherein the local activable heat source includes thermite.

6. The apparatus of claim 5, wherein the thermite includes a composition having a metal oxide and a reductant.

7. The apparatus of claim 6, wherein the metal oxide is selected from a group consisting of iron oxide and copper oxide.

8. The apparatus of claim 7, wherein the reductant is selected from a group consisting of aluminum and silicon.

9. The apparatus of claim 1, further comprising:

a starter mix positioned adjacent the local activable heat source, the starter mix being ignited to start an exothermic reaction in the heat source.

10. The apparatus of claim 1, wherein the local activable heat source is adapted to heat the composite sleeve to greater than about 50° C. above the ambient temperature of the well.

11. The apparatus of claim 1, further comprising:

a carrying tool for carrying the inflatable sleeve, the composite sleeve, and the heat source down the well to the casing portion.

12. The apparatus of claim 11, wherein the well includes a production tubing having a first diameter, and wherein the carrying tool has a second diameter less than the first diameter to allow the carrying tool to be lowered down the production tubing.

13. The apparatus of claim 11, wherein the carrying tool further includes means for inflating the inflatable sleeve, and wherein the local heat source is an exothermic heat energy source mounted centrally within the tool and means to inflate the inflatable sleeve that enables heat transfer from the energy source to the inflatable sleeve.

14. The apparatus of claim 1, further comprising:

a conformable layer extending around the composite sleeve, the layer acting to form a seal between the composite sleeve and the inner wall of the casing portion.

15. The apparatus of claim 1, further comprising a unitary downhole tool including an assembly of the inflatable sleeve, the composite sleeve and the local activatable heat source positioned to provide curing heat to the composite sleeve.

16. A method of sealing an inner wall of a portion of a casing in a well, comprising:

lowering an assembly of an inflatable sleeve, a composite, curable sleeve, and an energy source down to the casing portion using a carrying tool;

positioning the inflatable sleeve having an outer surface down the well at the portion of the casing, and the composite, curable sleeve extending around the outside of the inflatable sleeve;

inflating the inflatable sleeve to compress the composite sleeve against the surface of the inner casing wall; and activating a local energy source to cure the composite sleeve to form a hardened sleeve, wherein the hardened sleeve presses against the inner wall of the casing portion to create a fluid seal.

17. The method of claim 16, wherein the well includes a production tubing, the method further comprising lowering the assembly through the production tubing to the casing section.

18. The method of claim 16, wherein the local energy source includes an exothermic heat energy source for generating heat energy to cure the composite sleeve.

19. The method of claim 18, wherein the composite sleeve includes a mixture of resin and a curing agent.

20. The method of claim 18, further comprising:

curing the mixture to a hardened layer after exposure to the heat.

21. The method of claim 18, wherein the exothermic heat source includes thermite.

22. The method of claim 18, further comprising:

igniting a starter mix positioned adjacent the exothermic heat source to initiate an exothermic reaction in the heat source.

23. The method of claim 18, further comprising:

using the exothermic heat energy source to increase the temperature to greater than 50° C. above the ambient temperature of the well.

24. The method of claim 16, wherein a conformable layer extends around the composite sleeve, the layer acting to form a seal between the composite sleeve and the inner wall of the casing section.

25. The apparatus of claim 9, wherein the starter mix includes a composition ignitable with a firing resistor.

26. The apparatus of claim 25, wherein the starter mix composition includes a mixture of barium oxide and magnesium.

* * * * *